US008458932B2

(12) United States Patent
Schnuckle

(10) Patent No.: US 8,458,932 B2
(45) Date of Patent: Jun. 11, 2013

(54) OPTICAL ILLUSION DEVICE

(75) Inventor: Gary Schnuckle, Altadena, CA (US)

(73) Assignee: Alameda Technology, LLC, Burbank, CA (US)

( * ) Notice: Subject to any disclaimer, the term of this patent is extended or adjusted under 35 U.S.C. 154(b) by 1581 days.

(21) Appl. No.: 11/463,941

(22) Filed: Aug. 11, 2006

(65) Prior Publication Data

US 2008/0034627 A1 Feb. 14, 2008

(51) Int. Cl.
*G09F 3/00* (2006.01)

(52) U.S. Cl.
USPC ..... 40/306; 40/310

(58) Field of Classification Search
USPC ..... 40/306, 310
See application file for complete search history.

(56) References Cited

U.S. PATENT DOCUMENTS

| | | | | |
|---|---|---|---|---|
| 2,810,978 | A * | 10/1957 | Chapman | 40/310 |
| 4,094,501 | A | 6/1978 | Burnett | |
| 4,115,939 | A | 9/1978 | Marks | |
| 4,613,128 | A | 9/1986 | Lasky | |
| 5,139,455 | A | 8/1992 | Israel | |
| 5,229,884 | A | 7/1993 | Kelderhouse et al. | |
| 5,257,130 | A | 10/1993 | Monroe | |
| 5,476,194 | A | 12/1995 | Hippely et al. | |
| D375,678 | S | 11/1996 | Owsiany | |
| 5,676,401 | A | 10/1997 | Witkowski et al. | |
| 5,695,346 | A | 12/1997 | Sekiguchi et al. | |
| 5,758,440 | A | 6/1998 | Yudin | |
| 5,782,547 | A | 7/1998 | Machtig et al. | |
| 5,782,698 | A | 7/1998 | Keller | |
| 5,787,618 | A | 8/1998 | Mullis | |
| 5,788,579 | A | 8/1998 | Cherry et al. | |
| 5,799,939 | A | 9/1998 | Schneider | |
| 5,871,404 | A | 2/1999 | Weinreich | |
| 5,884,421 | A | 3/1999 | Key | |
| 5,951,405 | A | 9/1999 | Eigenmann | |
| 6,050,011 | A | 4/2000 | Hess et al. | |
| 6,050,414 | A | 4/2000 | Saffron et al. | |
| 6,080,067 | A | 6/2000 | Leff | |
| 6,135,654 | A | 10/2000 | Jennel | |
| 6,272,777 | B1 | 8/2001 | Swenson | |
| 6,336,725 | B1 | 1/2002 | Cianfichi, Jr. | |
| 6,581,972 | B2 | 6/2003 | Nojima et al. | |
| 6,622,878 | B1 | 9/2003 | Frey | |

(Continued)

OTHER PUBLICATIONS

Optigone Associates, Mirage Model 22 Gigantic 3D Hologram Maker, www.optigone.com, Jun. 20, 2006.

*Primary Examiner* — Joanne Silbermann
*Assistant Examiner* — Syed A Islam
(74) *Attorney, Agent, or Firm* — Marsh Fischmann & Breyfogle, LLP; Kent A. Lembke

(57) ABSTRACT

An apparatus for creating a visual display. The apparatus includes a mirror element and a framing element. The mirror element has a curved reflective surface and a printed primary image contacting the reflective surface. The framing element is spaced apart from the mirror element and includes a background image element positioned to face toward the reflective surface. The framing element also includes a transparent view port that is positioned opposite the primary image so as to provide a line of sight through the framing element to the reflective surface and the primary image. The apparatus further includes a lens sandwiched between the mirror and framing elements, such as a lens with a cylindrical body, formed of a transparent or translucent plastic, ceramic, glass, or other material. The apparatus may include a light source that transmits light into the lens or onto the primary image or the background images.

36 Claims, 10 Drawing Sheets

U.S. PATENT DOCUMENTS

| | | | | |
|---|---|---|---|---|
| 6,943,953 | B2 | 9/2005 | Raymond | |
| 6,945,872 | B2 | 9/2005 | DeVogel | |
| 6,976,678 | B1 | 12/2005 | Setteducati | |
| 7,001,033 | B1 | 2/2006 | Olsen et al. | |
| 7,010,877 | B2 * | 3/2006 | Geary | 40/310 |
| 7,016,116 | B2 | 3/2006 | Dolgoff | |
| 7,057,823 | B1 | 6/2006 | Raymond | |
| 2005/0075176 | A1 | 4/2005 | De Vogel | |
| 2005/0083676 | A1 * | 4/2005 | VanderSchuit | 362/84 |

* cited by examiner

OPTICAL ILLUSION DEVICE

CROSS-REFERENCE TO RELATED APPLICATIONS

This application is related to co-pending U.S. patent application Ser. No. 11/463,951, filed with this application, and entitled "Container with Reflective Surface for Creating a Multi-Dimensional Visual Display," which is incorporated herein by reference in its entirety.

BACKGROUND OF THE INVENTION

1. Field of the Invention

The present invention relates, in general, to packaging and labeling techniques that produce objects with imagery, and, more particularly, to objects and optical illusion devices, and methods for manufacturing such objects and devices, that produce an image that appears displaced from the object's or device's surfaces or produce a composite image that has multi-dimensions or effects such as a foreground image, a primary or central image, and a background image with each appearing to be in a differing plane to provide a three dimensional effect.

2. Relevant Background

Companies marketing their products are continuously searching for better ways to differentiate their product from competitors' products on crowded retail shelves. This is particularly true for products that may be similar in taste, appearance, or other characteristics such as water, alcoholic and non-alcoholic beverages, and many other consumer products including shampoo, liquid soap, and the like. To differentiate their products, these companies have turned to packaging to try to create increased shelf appeal and cause a consumer to select their product over a competitor's product at the point of sale or point of purchase. For example, shrink sleeve labels, wrap-around labels, or other labels may be used to package a consumer product and include colorful images or eye-catching graphics that are intended to attract a consumer and cause them to purchase the product. In some cases, the product or object itself may be configured to provide such graphics. For example, glasses, candies, keepsakes, and other consumer products are often selected based on their appearance rather than their function. A product's packaging or on-shelf appeal is particularly important for products that may be selected based on price or for other factors other than brand loyalty and for products that are new to a market. In these cases, consumers often will select one product over another simply due to the way it is packaged or its appearance.

Products are often packaged in bottles, cans, jars, cups, and/or containers that have an unusual shape such as placing syrup in a bottle having the shape of a person or of a log cabin. Alcoholic beverages such as vodka may also come in unique shapes to attract a consumer's attention. More commonly, an object such as a bottle with a standard shape is used and labels that are colorful or include colorful or graphic images are applied to attract consumers. For example, recent packaging innovations include labels for clear liquid containers that are adapted to allow a consumer to view an image through the container walls and the liquid in the container with the image appearing affixed on the container wall. With these consumer products, an image may be printed on a label that is attached to the back of the product or object or an image may be printed directly onto the back side of the product or its packaging. With some consumer products, wraparound labels are applied that include text on the interior surfaces that is visible through a clear liquid in the container or object holding a product or is visible after a more opaque liquid is removed (e.g., to provide contest results or other information after a beverage is consumed). Packaging may even include labels with lens materials to magnify an image, to create a three dimensional image, and/or to create a moving image. An ongoing challenge is to develop product and packaging innovations that achieve new effects or imagery with little or no increase in the cost of the product or its packaging.

There continues to be a demand for innovative consumer products that increase the shelf appeal of the products. Such innovation may include packaging designs and techniques that provide differentiating imagery or graphics for an object while limiting added packaging costs in many cases, it would be desirable for the object or its packaging to produce optical illusions. In other words, many consumer products or retail objects would have significantly increased shelf-appeal if the consumer product or retail object was presented in an optical illusion device or was designed such that they were optical illusion devices or produced eye-catching optical effects.

SUMMARY OF THE INVENTION

The present invention addresses the above problems by providing objects (and methods of manufacturing such objects) or optical illusion devices that are adapted for creating multi-dimensional displays or effects. The invention also provides one or more labels or other visual display assemblies that may be attached to or provided within such objects or devices. Generally, the devices each include a reflector or reflective surface on a rear side of a clear or translucent (or partially transparent or translucent) body (e.g., a plastic, ceramic, or glass body). A central or primary image is provided on or near this reflective surface. A framing element is provided on or near the front side of the body, and this framing element includes an image pattern and a clear viewing port or window (with "port" or "window" being any portion of the framing element through which a viewer's line of sight is directed and not being limited to a complete or enclosed frame/boundary). The image pattern may include background images abutting the body exterior surface or that are positioned elsewhere to be spaced apart from the reflective surface. During use, the view port directs a viewer's line of sight toward the reflective surface and the primary image. Foreground images may be provided by viewing the outward facing side of the background images or with additional printed images provided on the framing element. In this way, the optical illusion device effectively generates a multi-dimensional graphic or display because a viewer concurrently views the foreground image(s), the central or primary image at the rear portion of the device body on or in front of the reflective surface, and also the background images via the reflective surface. The background images appear to the viewer to be physically behind the primary or central image.

The visual effects may be achieved in containers, objects, or a variety of "optical illusion devices" that may be useful for containing a product or simply be useful for generating the desired multi-dimensional effects. For example, an apparatus is provided that includes a mirror element and a framing element (e.g., a visual display assembly). The mirror element includes a reflective surface or reflector element with a curved shape and also includes a printed primary image contacting the reflective surface and conforming, at least partially, to the curved shape of the reflective surface. For example, the reflective surface may have a semi-circular cross section and the image would conform to this shape, and in some cases, the curve is inward in the apparatus or the reflective surface may be considered concave relative to a central axis of the apparatus. The framing element is spaced apart from the mirror element and includes a background image element positioned to face toward the reflective surface. The framing element also includes a view port proximate to the background image that is transparent or substantially transparent and is positioned generally opposite the primary image so as to provide a line of sight through the framing element to the reflective surface and the primary image. The apparatus further includes a lens sandwiched between the mirror and framing elements and, in some embodiments, the lens has a cylindrical body (or body with curved surfaces for mating with framing and mirror elements) that may be formed of a transparent or translucent plastic, ceramic, glass, or other material. The apparatus may also include a light source, such as a light emitting diode (LED), that selectively transmits light (white or colored light) into the lens, e.g., the generated light may be directed onto the primary image and/or the background image or generally into the lens or space between the framing and mirror elements. The background images may be printed images (e.g., be formed with ink) and/or may be formed with the use of raised and/or recessed contours or portions that generate a particular reflected image from the reflective surface. In some cases, the framing element and the mirror element are provided in a packaging assembly that is applied to or about the exterior surfaces of the lens (e.g., as a one or two part label or as part of a container or package made of plastic or the like that is used to at least partially encapsulate the lens, which may be a unitary body, a shell or container filled with liquid such as a bottle, a globe, or the like, or take other forms). The invention may be thought of as "multi-effect" in that: the reflective surface creates a floating/centering effect for a primary image or object through reflected background image(s) and distortion; the optics of containers and objects configured according to the invention support this centering of a primary image and also may create an animation effect through point-of-view (POV) image shift and distortion. The optics of the containers or objects also create a disappearing effect by "erasing" the image between the mirror and sidewall through total internal reflection when the container or object is viewed through an off-angle surface (e.g., not viewed through the viewing port/window or framing element).

In another aspect of the invention, an apparatus is provided for generating visual display. The apparatus includes a body formed of material that is at least partially transparent to light. The body has a front sidewall and an opposing back sidewall. A mirror element is provided on or positioned proximate to the back sidewall, and the mirror element includes a non-planar reflective surface or layer that faces toward the front sidewall. A primary image element is positioned between the reflective surface and the front sidewall. The primary image element may be a printed image provided on the reflective surface, and in some embodiments, the reflective surface and the printed image have an arcuate cross section (e.g., as viewed along a longitudinal axis of the mirror element). For example, the back sidewall may have an exterior surface with a semi-circular cross section and the reflective surface may be mounted to abut and conform to this exterior surface. In other examples, the mirror element is mounted within the body and spaced apart from the back sidewall, such as when the body is formed from one or more pieces of plastic, ceramic, glass, or the like and the curved mirror element is embedded within or provided within the body. The apparatus may further include a framing element proximate to the front sidewall and opposite the reflective surface, e.g., attached to its exterior surface or positioned within the body as described for the mirror element. The framing element includes background image elements provided on a surface of the framing element so as to face into the body toward the reflective surface. A view port is provided in the framing element that is formed of a transparent material and configured with a shape or outline to provide a line of sight through the background image elements to the reflective surface and primary image.

According to another aspect, an item is provided for creating an optical illusion or display. The item includes a reflective element, a primary image, and a framing element. The primary image is provided proximate to the reflective element and positioned such that the primary image and reflective element can be viewed together over a range of viewing angles. The framing element is provided to permit viewing or views through to the reflective element at the range of viewing angles. For example, a line of sight may be provided through the framing element to the reflective surface and the primary image. This line of sight (or a plurality of such lines of sight) may be available or provided by the framing element over a range such as 0 to 270 degrees, 0 to 180 degrees, 0 to 90 degrees or the like relative to the primary image. Alternatively, such a viewing angle may be measured relative to a plane passing perpendicularly through the primary image and then, providing a range of about 0 to 135 degrees in both directions or more typically from about 15 to 45 or more degrees in both directions. The primary image may be printed or painted on the reflective element or attached to the reflective element in some embodiments. An opening may be provided or formed in the reflective element with the primary image being positioned behind the reflective element to be viewed through the framing element and the opening in the reflective element. The primary image in contrast may be in front of the reflective element (e.g., provided between the reflective element and the framing element). The reflective surface or element may be a metal layer or, in some cases, be formed of paint. The invention includes assemblies including the item such as labels, containers, bottles, pens, toys, novelty products, and the like.

DETAILED DESCRIPTION OF THE PREFERRED EMBODIMENTS

Figure 1:
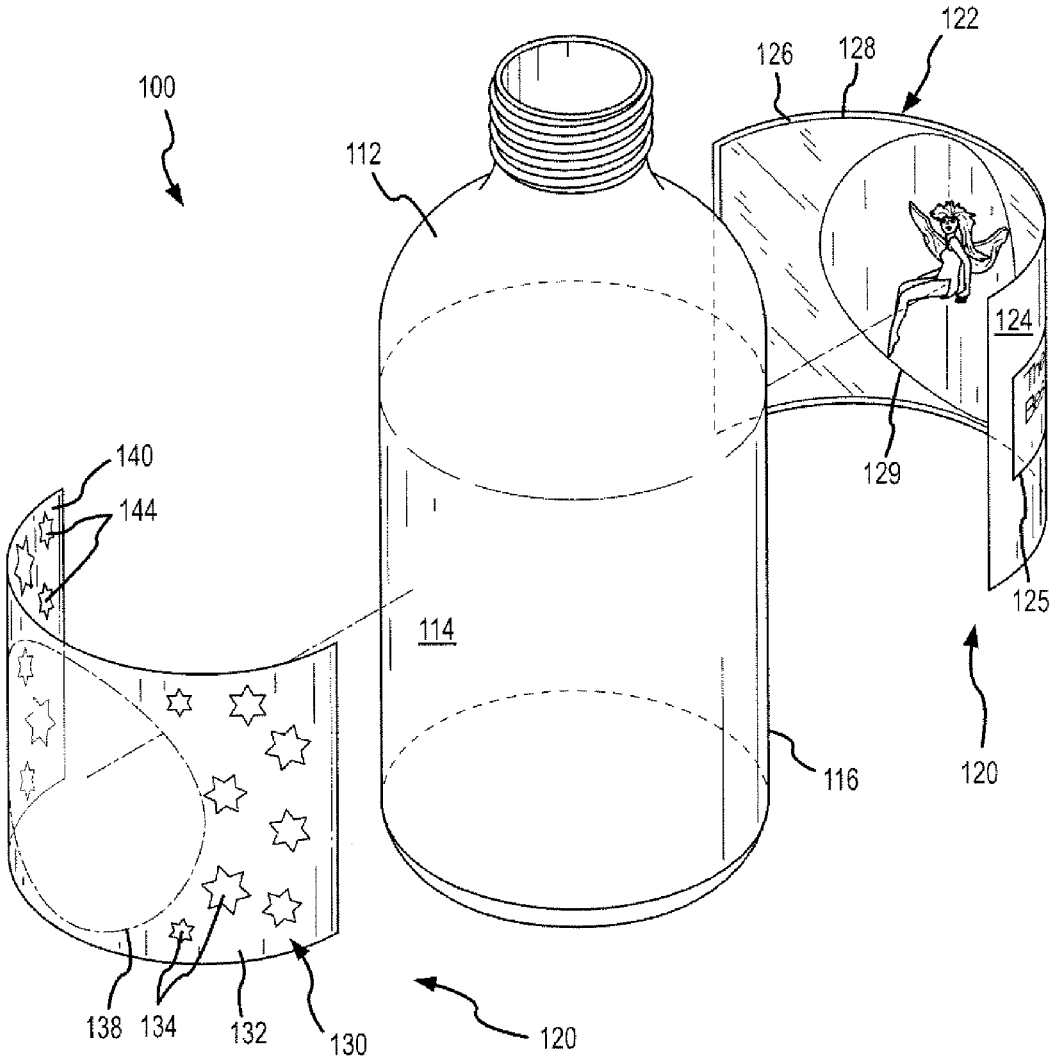
FIG. 1 is an exploded perspective view of a container with a visual display assembly of the present invention for generating an image or graphic display to a viewer outside the container.

Briefly, the present invention is directed to optical illusion devices such as object or products packaged or labeled to create an image that appears displaced from the object's surface. The invention is particularly well suited for use with objects or assemblies that have substantially transparent or translucent walls (or at least a portion that is translucent or at least partially transparent) and that may be used to contain or hold clear or translucent liquids, but the invention is also useful for creating displays when the objects or assemblies are emptied, which makes it attractive for use with keepsake, promotional, and reusable products. Devices, objects, products, and the like produced or designed according to the invention are able to achieve such floating, multidimensional, and/or multi-effect imaging by providing a visual display assembly on an exterior or interior surface, as an integral component of, or within a clear or translucent sidewall (e.g., a clear or substantially clear plastic, ceramic, or glass sidewall of an optical illusion device such as a consumer product or retail object).

The visual display assembly is made up of a mirror element provided on a rear portion of the sidewall (i.e., a substantially transparent or translucent portion of the sidewall) and may include an optional framing element provided on a front portion of the sidewall. The mirror element includes a reflective surface on its interior side that is placed proximate to the sidewall. A central or primary image is positioned in front of the reflective surface, e.g., printed on this reflective surface, provided on the rear portion of the sidewall to contact or be surrounded by the reflective surface, or sandwiched between the reflective surface and the sidewall. The framing element includes a viewing window or port that is transparent and permits a viewer's line of sight to be toward the central image on or near the reflective surface. The framing element also includes background images that may be provided on the sidewall or on an interior surface of a label (e.g., a front label or portion of a wraparound label) or sandwiched between the sidewall and the framing element.

The background images are visible through the viewing window as they are reflected off of the reflective surface. The framing element may also include foreground images as separate printed images on an exterior surface of a label or as the reverse side of the printed image used to provide the background images. These foreground images are positioned about the viewing port and are visible from outside the optical illusion device. In some embodiments, the sidewall comprises contours such that the mirror element and framing element are curved or arcuate in cross section. In these embodiments, the sidewall contours may be smooth such as a circle or parabola or may be complex or discontinuous comprising curved and straight portions. The sidewall contours may be two-dimensional or three-dimensional. The resulting display comprises a composite image or display in which the foreground images appear in front of the central image, the central image appears to be on the rear wall or inside the optical illusion device, and the background images appear to be behind the central image. In many cases, the composite image creates an illusion that the primary image is displaced within the container as if it were floating in the optical illusion device. The devices, objects, products, assemblies, and the like described herein are in this manner able to effectively create a multilayer or multidimensional display by providing a composite image by combining image components attached to or provided as part of the device in two sets or elements such as in two semi-cylindrical labels, as part of a wraparound label, and/or as a combination of printed and attached components. In some embodiments, the visual display is enhanced by optical effects provided by the label, the sidewall, and also inclusion of clear or translucent liquids within the interior portions of the device between the framing element and the mirror element.

Further enhancements of the image are in some cases achieved by printing the images to account for distortions or optical effects due to the sidewall(s), the curvature of the reflective surface, the refractive index and diameter (or width) of the interior space defined by the sidewall(s), and/or other optical parameters. For example, the primary or central image may be printed with less width (i.e., thinner) to account for optical effects that cause the image created to be wider than the printed image, and similarly, the background images may be pre-distorted by printing them with a width that is greater than desired in the visual display to account for optical effects that cause the viewed image to be narrower than the printed version.

The framing element may in some embodiments be formed by printing the foreground images on an opaque frame or background on an exterior surface of a label, with the background defining the clear viewing window (e.g., a circle, an oval, a square, or other useful shape for permitting or directing a viewer's line of sight onto the primary or central image). In these cases, the background images may be provided on the interior surface of a label behind the foreground images but typically not in the viewing window. In other embodiments, the framing element is provided on a clear label (e.g., on the interior surface of the label and/or on the exterior surface of the label) or formed directly on a sidewall and includes a pattern that is visible both from the exterior of the device aid through the viewing window due to reflection. In certain embodiments, the viewing window may not necessarily be a defined shape but simply be provided by the configuration of the printed pattern (e.g., a viewer can view the reflective surface and the primary image and background image through clear portions of the pattern and these clear portions make up the viewing window or portal in these embodiments).

Figure 2:
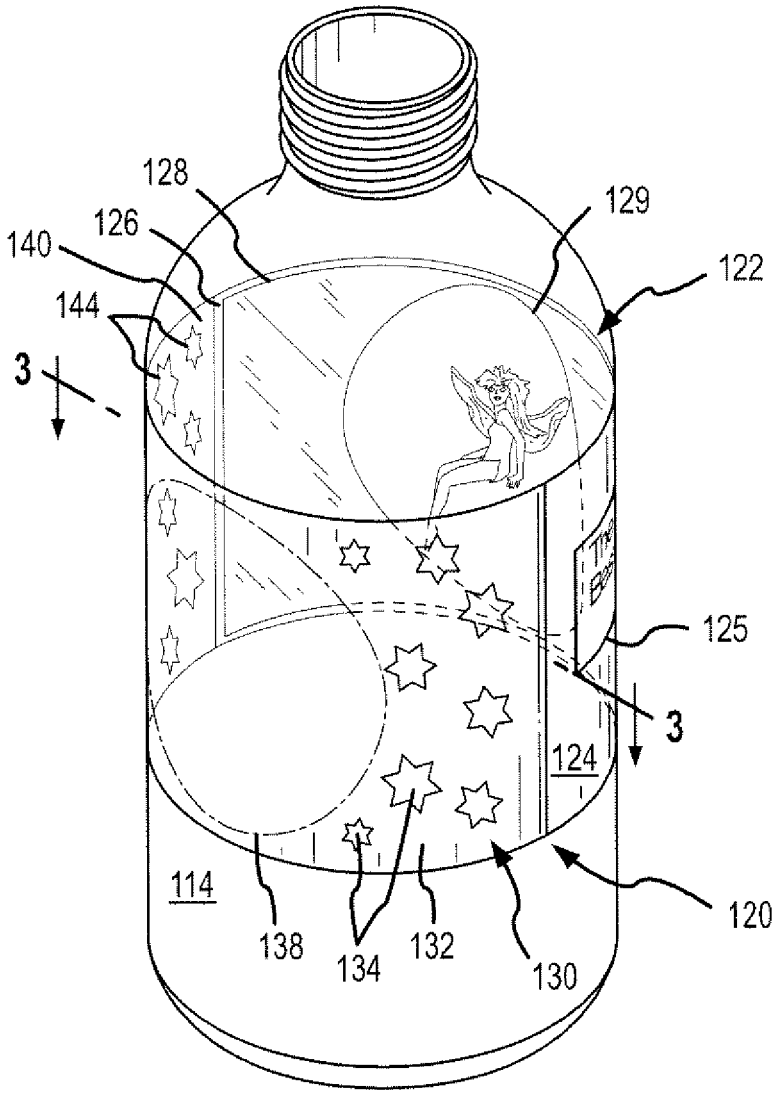
FIG. 2 illustrates the container of FIG. 1 in assembled form.
Figure 3:
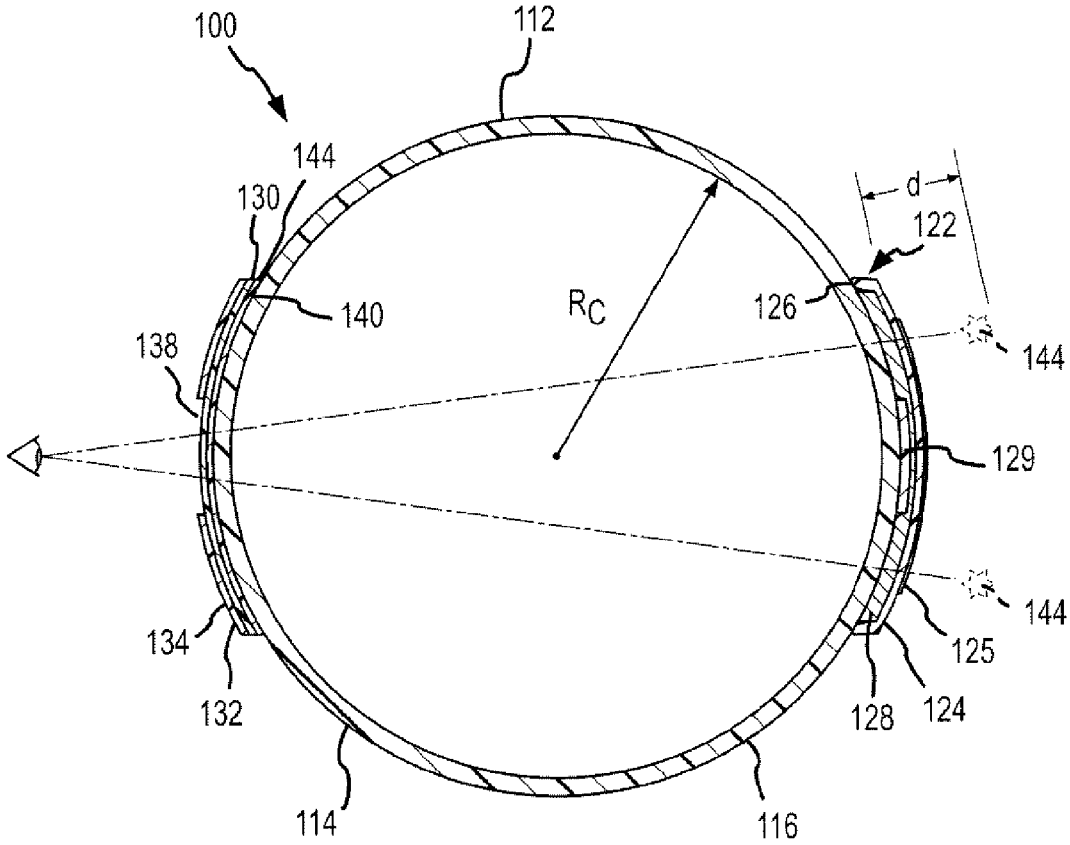
FIG. 3 is a cross sectional view of the container of FIGS. 1 and 2 taken at line 3-3 of FIG. 2 showing a lines of sight or viewing for a viewer through a view port or window of the visual display assembly to a reflective surface containing a primary or central image.

FIGS. 1-3 illustrate one embodiment of an optical illusion device according to the invention, which is a container in this representative example. Specifically, FIGS. 1-3 show a container 100 designed according to the invention for displaying images using a reflective surface. As shown, the container 100 includes a sidewall 112 with a first or front portion 114 and a second or rear portion 116. Of course, the designation of "front" and "rear" for a container or other object may be relatively arbitrary and should not be considered limiting of the invention with the intent being to describe two generally opposing portions, such as sidewalls, of a container or object. The sidewall 112 is used to form a bottle or jar (e.g., a standard water or beverage bottle, a consumer product container, or the like) with a cylindrical cross section with a radius $R_C$. The shape of such bottle or jar may take many forms to practice the invention and the radius $R_C$ may also vary widely, such as 0.25 inches to a few inches to up to a foot or more. The sidewall 112 typically is formed of clear or translucent materials such as clear or lightly colored plastic, ceramic, or glass. Sidewall 112 may be single walled or comprise multiple walls. The thickness of the sidewall 112 is not limiting to the invention but its thickness and material properties are typically considered in achieving a desired visual effect (e.g., by considering the refractive index of the container sidewall 112).

The container 100 includes a visual display assembly 120 for creating a multilayer or multidimensional display. The assembly 120 in this embodiment is formed of two separate labels that may be thought of as a mirror element 122 and a framing element 130, which are mounted, attached, or otherwise deposited, such as with adhesive to the rear and front portions 116, 114 of the sidewall 112, respectively, by heat shrinking of a label or labels containing the assembly 120, by tacking the mirror element 122 and applying a label or labels over the mirror element, or any other useful method for providing the assembly 120 and its components on or within a container or other object. The mirror element 122 includes a label substrate (such as a plastic such as, but not limited to, polyethylene terephthalate (PET), polyethylene (PE), polyvinyl chloride (PVC), oriented polypropylene (OPP), polyester PETG, other plastic, paper, or other material useful for labeling) with an exterior surface 124 and an interior or contact surface 126. The substrate of element 122 may be clear, translucent, opaque, or a variety of clarity levels to meet the needs of a particular applications. An optional text or graphic box 125 may be printed or attached to the outer surface 124, such as to provide product data, provide additional graphics, or the like.

Significantly, the mirror element 122 includes a reflective surface 128 that is formed of materials that function to reflect light that strikes it. In this regard, the reflective surface 128 may be formed integrally with the substrate of element 122 or may be attached in a separate operation or provided or formed as a separate element. In these latter cases, the reflective surface may be a thin metallic foil, another foil such as a metallized nylon, a metallized PET film, or similar foil that has reflective properties, a deposited coating, or any other single material or combination of materials that produce a reflective surface, which may in some cases even include coatings that provide a different index of refraction at the surface 128.

A primary or central image 129 is printed or otherwise positioned or provided on or proximate to the reflective surface 128 of the container 100. The image 129 in some embodiments is selected to be relatively elongated or tall (as measured along a longitudinal axis of the container 100) and to be relatively thin. This is because when the image 129 is viewed through the sidewall 112 (and front label or framing element 130) and any liquid (not shown) in the container 100, it appears wider. This can be thought of as "pre-distorting" the image 129 such that it appears with more expected or desired proportions when viewed. The image 129 may be a printed image as shown or, in some embodiments, the image 129 may be an image provided with electronic displays (such as liquid crystal displays, flat screens, or the like) and/or may be an "object." An object being understood to mean nearly any non-print or monitor/display image such as a 2D or 3D object mounted or provided on or proximate to the reflective surface 128. For instance, the object used for the primary image 129 may be a coin, a pressed flower, a butterfly or insect specimen, or nearly any other object, and in these embodiments, it may be useful for the surface 128 to be spaced off of the side wall 112 (or to not have one or more of the sidewall portions) and to provide an object with shallow (e.g., half) relief.

The container 100 may be empty (or only contain air) or it may be filled. If filled, the liquid, solid, or other material contained therein may be relatively opaque causing the image 129 to be only visible when the liquid is removed or the liquid may be transparent or translucent such as water, carbonated, alcoholic, or other beverages, or a consumer product such as shampoo, soap, bubble bath, perfume, mouthwash, toothpaste, hair gels, sanitizers, or the like. The invention is not limited to use with a particular liquid or content for the container 100, but it may be more effective in creating a desired image with particular clear, substantially transparent, or translucent liquids or solids (e.g., liquids or solids that allow a significant or only a small amount of light through and that are clear or tinted with color).

The visual display assembly 120 also includes a framing element 130 that may be provided with a separate label formed from a clear or translucent substrate, e.g., a thin layer of a clear plastic or similar material, that is attached with adhesive to the sidewall 112, e.g., the adhesive may be provided as a thin layer on the label or about the exterior/boundary of the element 130. As shown, the framing element 130 has an exterior surface 132 and an interior surface 140. The exterior surface 132 may be opaque or substantially opaque (such as by coloring it white or one or more other colors) and include one or more foreground images or patterns 134, with stars being shown in this example. The exterior surface or opaque frame on such surface 132 defines a viewing port or window 138 that is transparent or translucent, i.e., does not include the ink or printing that makes the frame portion opaque. Alternatively, framing element 130 may be formed from a single layer of translucent or semi-opaque material with window 138 formed as an opening through the material of framing element 130.

Figure 7:
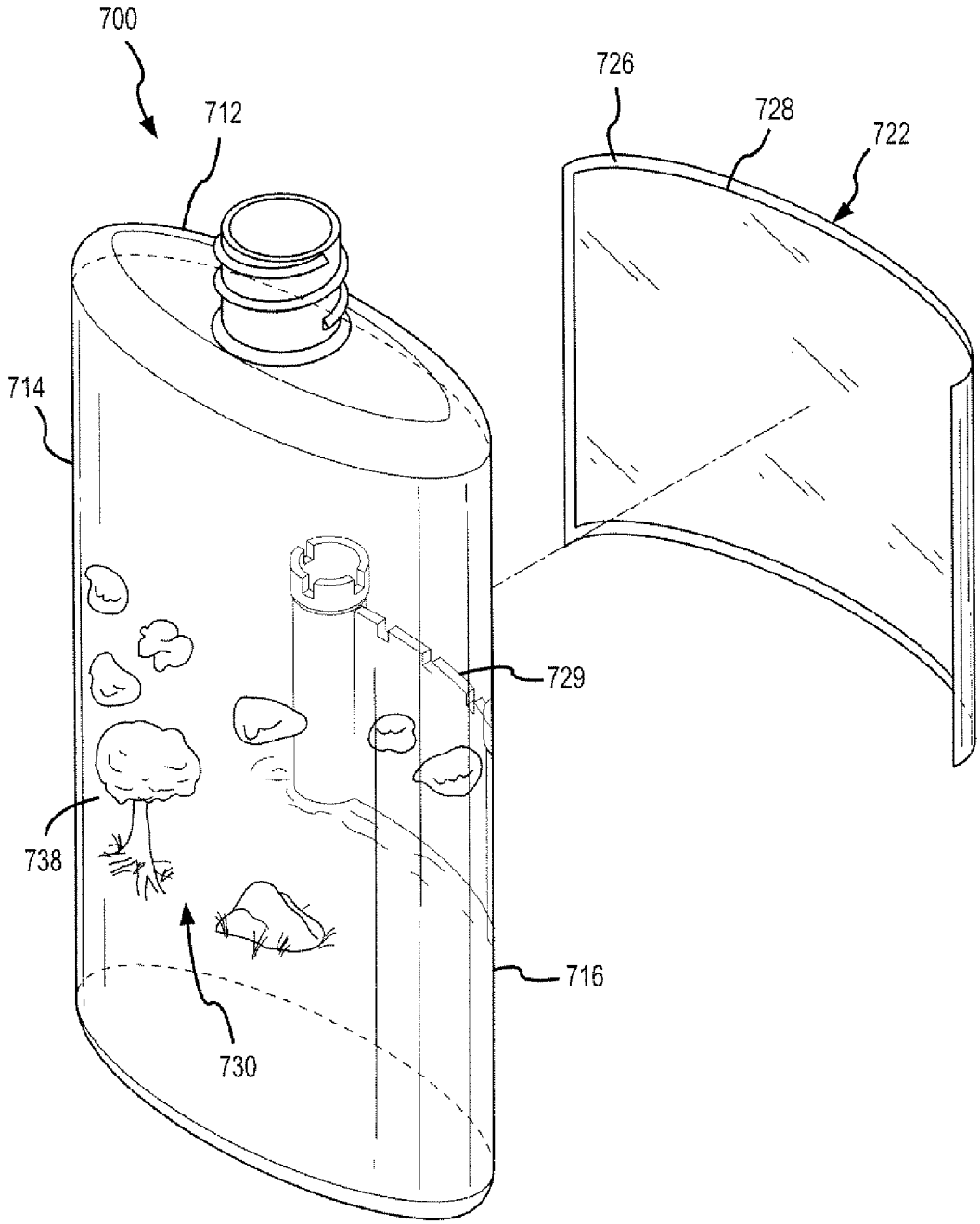
FIG. 7 is an exploded view similar to FIG. 1 of another embodiment of a container with a sidewall an oval cross sectional shape and with the framing element and the central or primary image being printed directly onto the container sidewall rather than being provided with a separate label, decal, or sticker.

The port or viewing window 138 guides or directs a viewer's line of sight through the framing element 130, through the container wall 112 (and any contents contained therein), and to the reflective surface 128 and the image 129. The shape of the port 138 is shown to be oval but in other embodiments the shape is circular, square, rectangular, triangular, or other shapes and in some cases, the port 138 may have an irregular shape (and may even include some foreground images 134) as shown in FIG. 7. The port 138 typically is selected to be the same size or smaller than the image 129 although this is not a requirement and is shown to have a shape similar to that of the image 129 but, again, this is not a limiting design parameter. Generally, the port 138 is selected to have a size and shape that minimizes or controls the amount of mirror or reflective surface 128 that is not "covered" by the foreground images 134 and/or frame 132 so as to enhance the achieved imagery or illusion (e.g., by reducing reflections of a viewer and other objects outside the container 100). Window 138 may be permanently opened or may be covered with a removable cover or flap (not shown) that allows a user to open or expose window 138 when desired.

On the interior surface 140 of the framing element 130, one or more background images 144 are provided. These images 144 may be printed or otherwise attached to the surface 140 or, in some cases, be provided as separate elements from the surface 140. The images 144 are positioned adjacent the port 138 and positioned so as to frame the image 129 when viewed on the reflective surface 128 through the port 138. The images 144 may be printed in mirror image arrangement so that they appear reversed or transposed (i.e., "correct") when viewed in the reflective surface 128 or are selected such that they appear correct or normal in the mirror. As shown, stars are used for the images 144 in part because they appear properly oriented when viewed directly or in a mirror or reflective surface. In other embodiments, surface 132 is not opaque and in these embodiments, the images 134 and 144 are typically visible directly as foreground images and through the reflective surface 128 as background images behind the central image 129.

The images 134 (and frame/surface 132), images 144, and image 129 may be provided as decals, stamps, or labels in a separate operation, but more typically, these images are printed onto the labels or elements 122, 130. The particular process used for applying the images 129, 134, 144 may be any of a number of printing techniques used in the labeling and packaging industries. For example, the images may be applied through flexographic printing as this type of printing is useful for applying thin uniform films of ink on plastic and other materials. Alternatively, rotogravure may be used to apply ink for the images to the elements 122, 130. In other cases, screen printing, web printing, pad transfer printing, letterpress printing, jet printing, or some other technique of printing may be used to practice the invention.

FIG. 3 illustrates a cross sectional view of the container 100. The view is shown out of true proportion with the ink/image layers and reflective surface shown with larger thicknesses to allow them to be seen in the cross section (e.g., the ink may be 0.005 or less in thickness in practice and the foil or other material used for reflective surface 128 may also be quite thin relative to the label or element substrates which may be several mils thick). As shown, the sidewall 112 defines a circular cross section with a radius, $R_C$, measured from the center of the void defined by the sidewall 112 or container to a point proximate to the positioning of the mirror element 122 and the framing element 130. The mirror element 122 is placed on rear portion of the container and generally takes the shape of the rear portion. In other words, the mirror element 122 is a semi-cylindrical shape when installed in or on the container 100, and as a result, the primary image 129 and reflective surface are arcuate or semi-circular in cross section as shown with a curvature defined by the container radius, $R_C$. For example, the radius, $R_C$ may vary in some embodiments from about 0.25 to about 6 inches (with larger sized containers also being considered a part of this disclosure). This semi-circular or arc cross section is useful for achieving the optical or display effects of the invention in some embodiments as the reflected background images 144 appear or are viewed as being behind the primary image 129 (which appears on the surface of rear portion 116 or slightly in font of the container wall 112 so as to "float" within the container interior space or volume). As shown, the viewed background images 144 shown in dashed lines are viewed or displayed at a distance, d, behind the primary image 129 due to the use of the reflective surface 128, positioning of the images on framing element 130 which is separated from the reflective surface 128 by about the diameter of the container sidewalls 112, and the distortions caused by the curvature of the reflective surface.

The width (or size) of the reflective surface 128 may vary to practice the invention. As shown, there may be a space or gap between the mirror element 122 and the framing element 130 (e.g., between the rear and front labels) but this is not required. In some embodiments, the reflective surface 128 extends significantly about the periphery of the sidewall 112 of the container, and may have a width that ranges from about one fourth to about three fourths of the circumference of the container sidewall 112 with a width of about one third or less being used in some cases such that the reflective surface extends about 120 degrees or less about the container wall 112. As shown, the inner surface 126 is attached, such as with adhesive about the boundary of the reflective surface 128, to the rear portion 116 of the container sidewall 112, and this forces the reflective surface 128 and primary image 129 to be proximate to or to contact/abut the exterior surface of the rear portion 116 of the container sidewall 112. The substrate of element 122 then overlies the reflective surface 128 with its exterior surface 124 facing outward from the container sidewall 112 and the data element 125 is printed or otherwise provided on this surface 124.

The framing element 130 is mounted on the front portion 114 of the sidewall 112 such as by using adhesive to attach the inner surface 140 to the exterior surface of the sidewall 112. The framing element 130 is mounted relative to the mirror element 122 such that the viewing port or window 138 guides a viewer's line of sight through the viewing port 138, the container and its contents to the primary image 129 and reflective surface 128. This may be thought of as registering or aligning the port 138 as well as foreground and background images 134, 144 with the mirror element 122 and its reflective surface 128 and primary image 129. As shown, the inner surface 140 contacts or is proximate to the exterior surface of the container sidewall 112 at the front portion 114, which causes the background images 144 and port 138 to be proximate to or contact the exterior surface The substrate of the framing element (or label) 130 is more distal to the container sidewall 112 with the exterior surface 132 and foreground images 134 typically being at least slightly spaced apart from the container sidewall 112 (e.g., by the thickness of the ink layer providing the background images and the thickness of the substrate of the framing element 130).

As shown with dashed lines, the lines of sight or vision for a viewer provided by the container 100 create a visual display. This display includes the foreground images 134 on the surface 132 of the framing element 130, the primary image 129 on or in front of the reflective surface 128 of mirror element 122 on the rear portion 116 of the container sidewall 112, and the background images 144 behind the primary image 129 (i.e., a distance, d, behind the image 129/reflective surface 128 as determined by the size of the container the refractive index of the container contents and sidewall 112 at rear portion 116, amount of curvature of reflective surface 128, and/or other optical parameters or characteristics of the container 100 and the visual display assembly 120).

In some cases, it may be desirable to provide the visual display assembly in a single label. For example, this may be useful for more accurately registering or aligning the primary image, reflective surface, and the framing element with its viewing port and images. Also, many consumer products are presently packaged using wraparound labels that are applied by rolling on a bottle with adhesive, by heat shrinking, or the like, and in some embodiments, the visual display assembly is provided in such a wraparound or single piece label.

Figure 4:
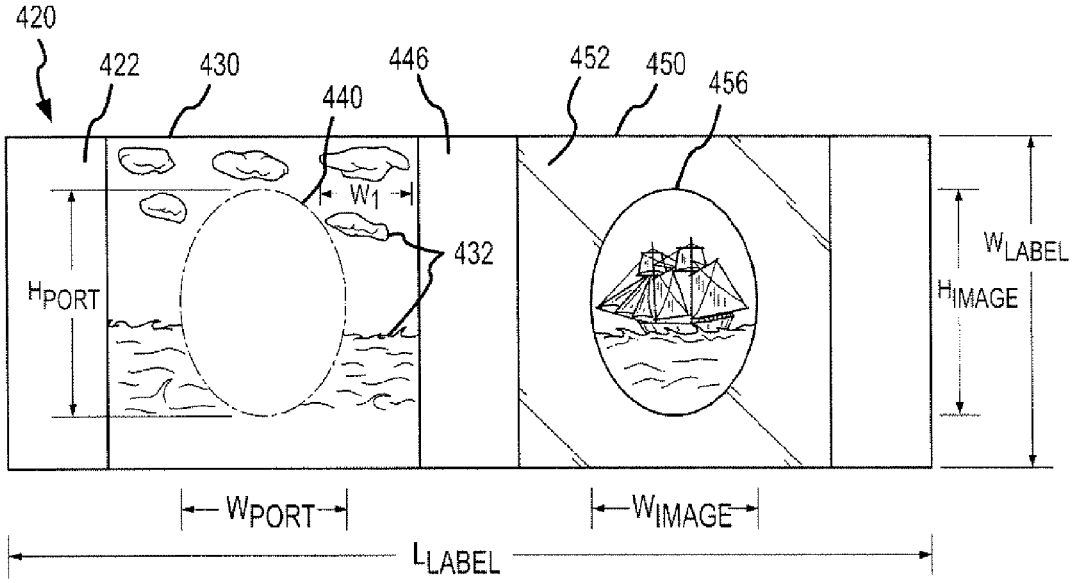
FIG. 4 illustrates an inner surface (i.e., the surface that contacts outer surfaces of a container sidewall) of a wrap-around label manufactured according to an embodiment of the present invention with a reflective surface and central image provided in a mirror element and background images and a view port or window provided in a framing element.

FIG. 4 illustrates a visual display assembly 420 of one embodiment of the invention that is provided on a wraparound label 422. The assembly 420 includes a framing element 430 that on the illustrated first or interior surface of the label 422 includes background images 432 (i.e., waves/water and clouds in this example) and a viewing port or window 440. As discussed with reference to FIGS. 1-3, the substrate of label 422 may be transparent or translucent and the port 440 may not be defined as shown with a regular boundary as shown but may instead be areas that are defined by areas in the framing element 430 which do not include background images 432 (and foreground images 433). Alternatively, the images 432 may create a scene or frame that is opaque or relatively opaque to define the port 430 and this scene or its images are reflected by the corresponding mirror element when the label 422 is attached to a container. The images 432 may be printed onto the surface of label 422 (such as with flexographic or other printing methods) or as a decal, stamp, or the like that is attached using adhesives or other bonding techniques.

The assembly 420 further includes a mirror element 450 that on the interior surface of the label 422 includes a reflective surface 452 (e.g. a metallic foil, metallized nylon, metallized PET film, a reflective coating, or the like). The reflective surface 452 may be applied to the surface of the label 422 in a separate process or be attached to a label sheet having the framing element 430. A primary image 456 is provided on the reflective surface 452, such as in a central or substantially central position in the surface 452. For example, the image 456 may be printed on the surface 452 and/or attached as a decal or sticker. In other embodiments, the image 456 is printed on the exterior surface of the container wall 112 and the reflective surface 452 is then applied or attached to the surface of label 422 and includes a port, frame, or window through which the image 456 is exposed for viewing (in other words, the image 456 is not provided on the surface 452 in all embodiments but is surrounded by, adjacent, and/or proximate the surface 452 in some embodiments and may be printed or applied to the surface for ease of manufacturing and assembly of a container). In another example, a hole is cut or provided in the reflective surface 452 and the image 456 is positioned within this hole. Specifically, a printed image 456 may be provided on an inner or outer surface of a label 422 (or on or in the wall 112 of the container) and the "hole" in the reflective surface be provided to mate with the primary image, and in this manner, the image 456 may be more prominent when viewing as ambient light shines through the label 422 and in some cases, image 456 to backlight the image 456.

A gap 446 may be provided between the framing element 430 and mirror element 450, such as to provide space for providing product information or the like, but this is not required and the elements 430, 450 may abut each other on the label 422. The mirror element 450 may be provided with nearly any shape, such as by die cutting. It may take a regular rectangular shape as shown in FIG. 4 or the boundaries may be irregular to suit a particular illusion and/or to integrate with surrounding portions of the label 422. The reflective surface 452 typically extends for only a portion of the length of the label, $L_{LABEL}$ so as to achieve a desired effect. For example, if the label 422 has a length, $L_{LABEL}$, selected to match a diameter of a container, it may be desirable for the width of the surface 452 to be less than about one half with some arrangements having a width of about one third of the label length, $L_{LABEL}$, or less so that the reflective surface extends about 120 degrees about a container circumference. It may be desirable to minimize the size of the mirror element 452 to control costs while still achieving a desired optical effect.

The primary image 456 has a height, $H_{image}$, and width, $W_{image}$, that may be selected to achieve a desired visual effect. For example, the height, $H_{image}$, may be selected to be at least equal to or significantly larger than the width, $W_{image}$, and to be less than the width, $W_{label}$ of the label 422, such that the image 456 is "tall" and thin as printed but will appear well proportioned or "normal" to a viewer after distortion effects causes by the curvature of the applied label 422 and the refractive index of container contents such as water, other beverages, or other liquids. Similarly, the background images 432 may have a printed width, $W_I$, that is selected to account for optical effects that may cause the reflected image to appear thinner, e.g., printed with a width, $W_I$, that is larger than a desired width of a reflected version of the image. The selected adjustments or changes in printed image dimensions are selected for an intended container size, sidewall material, and cross sectional shape as well as expected contents for such a container. For example, the central image 456 may be pre-distorted to be between 20 and 50 percent (such as about 30 percent) thinner than the width that is desired to be presented in the created display (i.e., as viewed by a viewer) as measured about an axis transverse or perpendicular to the longitudinal axis of the container 400. Similarly, the background images 432 may be made wider by similar amounts so that they appear at a desired thickness or width in the viewed display.

The port 440 also may be configured or defined to have a height, $H_{port}$, that is about the same as or less than the height, $H_{image}$, of the image 456 and to have a width, $W_{port}$, that is about the same as or less than the width, $W_{image}$, of the primary image 456. However, in some embodiments, the port 440 may be intentionally made smaller or larger than the image 456 to achieve a desired visual effect (e.g., to force a viewer to scope or view the image 456 through the port 440 with the container closer to their eyes or to provide a larger view of the reflective surface 452, respectively).

Figure 5:
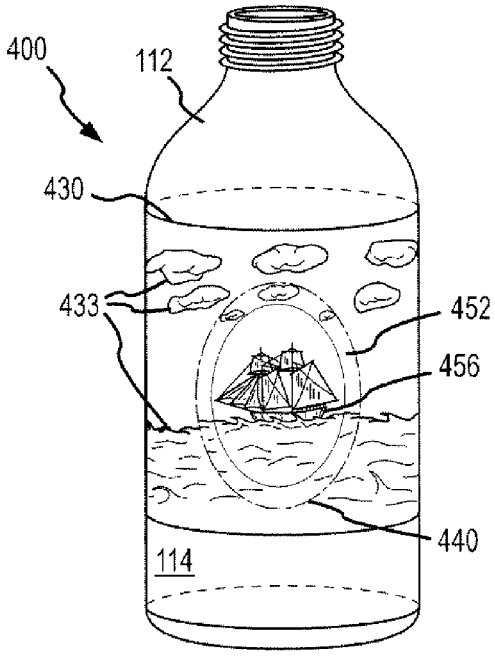
FIG. 5 illustrates a container with the label of FIG. 4 attached to generate a multidimensional display according to the invention including foreground images, a central or primary image, and background images.

FIG. 5 illustrates a container 400 with the label 422 attached with the inner surface shown in FIG. 4 applied to a container sidewall 112 so as to provide a visual display with multi-dimensions or layers with a wraparound label. The sidewall 112 may take the shape and circular cross section as shown in FIGS. 1-3, e.g., the container 400 may include a standard plastic, ceramic or glass beverage bottle or consumer product bottle or jar (e.g., the wraparound label 422 may be applied by heat shrinking or rolling onto a standard water bottle, a carbonated or health drink bottle, a beer, wine, or other alcoholic beverage bottle, or the like). In other embodiments, the wraparound label 422 may be applied to containers that do not have a circular cross section, such as containers with a polygonal cross section or have one or more relatively flat surfaces (such as currently produced sport or health drink bottles), shampoo, soap, and other consumer products with oval or elliptical cross sections, and other non-circular cross section containers. When the mirror element 450 is curved to some extent it is possible to achieve more dramatic visual effects (e.g., see FIG. 6) but this is not required to practice the invention.

When the label 422 is applied to the container sidewall 112, the framing element 430 allows a viewer observing the container 400 to see a visual display that includes the foreground images 433 in the framing element 430 on the front portion 114. Also, through the port or window 440, the viewer sees the primary image 456 which appears to be "floating" in part because the background images 432 are seen via reflection from the reflective surface 452 to be behind the primary image 456 due to their positioning on the inward facing surface of label 422 or framing element 430. While not required, it is often desirable to select an adequate quantity of background images 432 relative to the primary image 456 to provide a desirable ratio of these images to enhance the floating or multi-dimensional effect or illusion. Again, it is typically desirable to select images 432 that are either printed in mirror image on the label 422 or that appear properly oriented when viewed in the reflective surface 452 (such as symmetric graphics or text/symbols (e.g., A, O, I, W, and the like)). In some embodiments, the foreground images 433 are not additional images printed on a second or exterior facing surface of the framing element 430 or label 422 but instead are simply the backside of background images 432 printed or provided on the inward or interior surface of the framing element 430. In these embodiments, it is even more desirable to select images that appear correctly oriented when viewed from either side, such as symmetric images such as stars, clouds, waves, or the like that also make contextual sense or provide a eye-pleasing display as foreground images 433. In this case, the foreground images 433 would be viewed through the label substrate 422 which is selected to be transparent or at least translucent. The length, $L_{label}$, is typically selected to be at least about the circumference of the sidewall 112 and sometimes slightly larger to obtain an overlap of used in binding the label 422 to the container sidewall 112.

As discussed throughout this description, the visual display assembly and packaging concepts of the invention are useful with a wide variety of container materials and shapes. The containers may be filled with clear or translucent liquids, gels, solids, or gases to allow viewing when the containers are filled or may be used with opaque liquids, gels, or solids and provide display when the contents are at least partially moved or removed. With these many varying embodiments in mind, FIGS. 6 and 7 illustrate additional embodiments of the invention.

Figure 6:
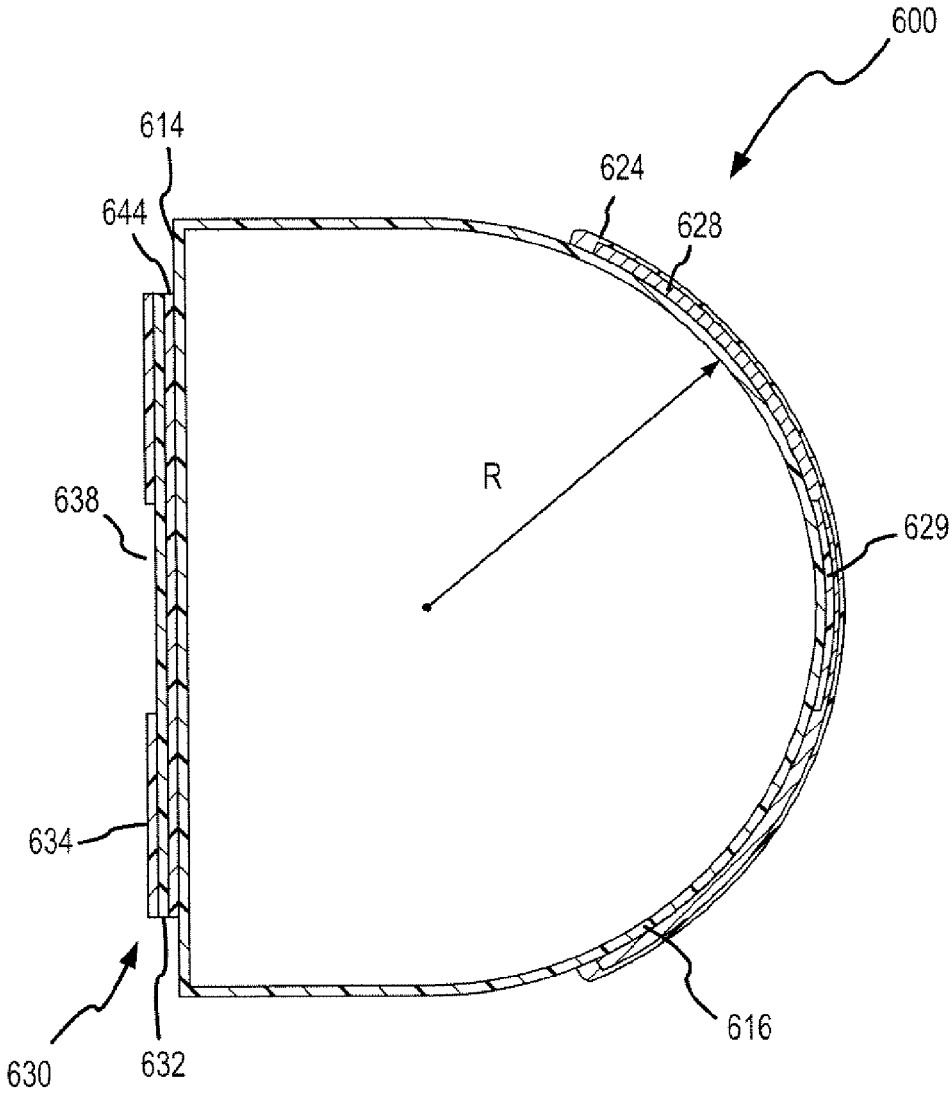
FIG. 6 is a sectional view similar to FIG. 3 of another container of the invention with two labels being used to provide a visual display assembly on a bottle with a "D" cross section.

The container 600 of FIG. 6 is shown to include a sidewall (e.g., clear plastic, ceramic or glass) 612 with a non-circular cross section. Specifically, this exemplary embodiment 600 provides a first or front wall or portion 614 that is flat (or only slightly curved) and a second or rear wall or portion 616 that is a semi-cylinder with a semi-circular or arc cross section (or parabolic, elliptical, or the like in other embodiments not shown), i.e., the container 600 has a "D" cross sectional shape. In this container 600, a mirror element 622 is attached to the curved rear portion 616 of the sidewall 612 to also take on a curved or arced cross sectional shape that has a curvature defined by the radius, R, of sidewall 612 at the rear portion 616. The mirror element 622 includes a substrate that may be opaque or transparent with an outer surface 624 distal from the sidewall 612, which may optionally include text or graphics visible from the outside of the container 600. A reflective surface 628 is provided on the inner surface of the mirror element 622 substrate, and may cover all or a portion of the substrate 628. A primary image 629 is provided on or adjacent the surface 628 (e.g., to be surrounded by the reflective surface 628) and may be printed or attached directly to the reflective surface 628 or to the rear portion 616.

A framing element 630 is mounted or provided on the flat, front portion 614 of sidewall 612. The framing element 630 may be similar to element 130 of FIG. 1 with background images 644 that are provided adjacent to the exterior surface of the front portion 614. The label or framing element 630 includes a transparent or translucent layer or substrate 632 in which a viewing window or port 638 is provided, e.g., with its shape and size defined by the positioning, size, and shape of the background images 644 and foreground images 634. The foreground images 634 may be separate components as shown (e.g., a layer of ink, a decal, or the like) or may be viewed versions of one side of the background images 644. In use, the container 600 directs a viewer's line of sight to the foreground images 634 and through the port 638 to the reflective surface 628 where the background images 644 are visible adjacent to and behind the primary or central image 629.

FIG. 7 illustrates a container 700 that may be useful for many consumer products that use non-cylindrical containers such as bubble bath, soaps, shampoos, and the like. The sidewall 712 is shown to include a front portion 714 and rear portion (or front and rear/back walls) that have an oval, elliptical, or other non-circular cross section. A mirror element 722 is attached, such as with adhesive, to the rear portion 716 and takes on the curved shape of the rear portion 716. This shape may be thought of as a portion of an ellipse or as an arc taken from a relatively large circle, and this shape results in a small amount or degree of curvature when compared with containers 100, 400, and 600 for the mirror element 722. In some cases, the mirror element 722 may be planar or only slightly curved or substantially planar to practice the invention. The mirror element 722 includes a reflective surface 728 on an interior surface 726, and this reflective surface 728 is positioned proximate to or in abutting contact with the exterior surface of rear portion 716 of sidewall 712 so as to face inward into the container 700. A primary or central image may be provided on or near the reflective surface 728 as shown with other embodiments.

Container 700 illustrates that one or more of the images may be printed directly on the exterior surfaces of the container sidewall 712 (or otherwise applied such as by separate labels, stickers, stamps, or decals). As shown, the primary image 729 (e.g., a castle or building in this example) is printed or otherwise attached directly to the exterior surface of the sidewall 712 in the rear portion 716 and is covered by the mirror element 722 such that the reflective surface 728 surrounds or is adjacent to one or more sides of the image 279. Similarly, the framing element 730 in this container 700 is printed or provided directly on an exterior surface of the front portion 714 of clear sidewall 712. The framing element 730 is shown to include one or more images 744, which provide both the foreground images and the background images as they are visible both from the exterior of the container 700 and via the reflective surface 728 through the container 700. More specifically, the reflective surface 728 that reflects the inward facing side of images 744 and the primary image 729 are visible through a viewing window or port 738 that is defined by the arrangement of the images 744 in the framing element 730. In other words, the port 738 is a clear or translucent area of the framing element 730 that does not include the images 744 and a viewer is able to see through the port 738 portion of sidewall 712 by looking through the pattern created between the images 744. Alternatively, port 738 may be formed by a cut-out portion that exposes portions of the outer surface of sidewall 712. In other embodiments, some or all of the images 744 may be provided on a clear or partially clear label, decal, stamp, or the like.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, the visual display assemblies shown and described above includes a single reflective surface with a single primary image and a single viewing window, but other embodiments may include more than one viewing window to direct a viewer's line of sight to one or more primary images provided on or proximate to one or more reflective surfaces. The images and reflective surface(s) may be provided on a smooth exterior surface of the container that is typically curved outward from the container (i.e., convex) but some embodiments may utilize mounting surfaces that curve inward toward the container (i.e., concave), with adjustments to pre-distortions made to the printed images (e.g., make the central image wider if on a concave surface and the background images narrower if on a concave surface). The illustrated embodiments generally show one or two labels being applied to a container so as to provide the visual display assembly. However, it will be readily understood by those skilled in the packaging and printing industries that the visual display assembly or portions thereof may be provided by other methods such as printing directly on a container sidewall or by deposition techniques. For example, the background images and primary images may be printed or deposited on the interior or exterior surfaces of the sidewalls followed by applying or attaching a reflective surface or layer over the primary image and a framing element with a viewing port over the background images. Alternatively, the framing element may be provided by deposition while the primary image and mirror element are provided by labeling techniques or any combination of such printing, deposition, or labeling methods may used to form containers or objects of the present invention. Also, certain embodiments of the invention provide one or more of the components of the visual display assembly within the container sidewalls such as on an interior surface, as an integral part of such sidewalls (such as by providing 3D contouring of the interior and/or exterior surfaces of the sidewall), within the a multi-layer or multi-component sidewall (e.g., the background image, the primary image, and/or the reflective surface or other components may be sandwiched or otherwise provided between two layers (e.g., an inner and outer layer) of multi-part sidewall), or even within the void defined by the sidewalls.

In some embodiments, the foreground, background, and/or primary images may be provided in a manner that allows them to be changed. For example, a container may be configured such that one or more of these images is a decal, sticker, or the like that can be removed and replaced with a differing decal, sticker, or the like with a different image (e.g., allow a user to replace a primary image with a photograph of themselves to place them in the display). These embodiments may include having the primary image being provided on a sticker or decal (or separate label) that can be "plugged" in or inserted into a space in the reflective surface (such as by leaving a hole or gap in the substrate upon which the reflective surface is mounted or provided). Alternatively, the images may be adapted for alteration such as by coloring, painting, or the like or may be later provided by a consumer, e.g., by providing a space or canvas area upon which the images may be placed. In some cases, the images may be provided using electronics rather than printing such that they may be changed (e.g., by changing a screen provided on the reflective surface or in the framing element to show differing images from memory). For example, the primary image or primary image element may be provided with a liquid crystal display (LCD), a flat screen, or other electronic display device. In some cases, a flexible electronic display such as a flexible LCD may be used as the primary image element.

The invention provides an optical illusion assembly (or visual display assembly) that may take the form of a label or labels, decals, and other packaging and a lens system that may take the form of a container as discussed above or take other forms as described below (e.g., solid transparent objects or the like). The optical illusion assembly includes a primary image provided on or near a mirror element with a reflective surface. The reflective surface is typically at least slightly or partially curved (at least on one axis) or is non-planar. Often, this is achieved by providing the reflective surface on a conformable mirror element (e.g., a metallic layer, metallized plastic, or the like) on or attached to a thin, flexible plastic layer such as is found in wraparound labels attached to plastic containers. The reflective surface may, in these cases, be applied to a container or other object so as to take on the curve or shape of the outer surfaces of the container or object walls. In contrast, prior devices using mirrors generally used rigid, planar mirrors (e.g., mirrors set at 45 degrees from a front exterior surface) and often only achieved their effects by placing three dimensional objects within the container or lens portion (such as in cubes with mirrors). The curved mirror of embodiments of the present invention provides significant improvements by better disguising or hiding that a viewer is looking at a mirror.

The optical illusion assembly and lens system of the invention achieve several desirable results. The reflective surface with the proximate printed image and distal foreground images along with the optical characteristics of the lens system create the illusion that the printed image appears in front of the reflective surface such as inside a container or other object. However, the configuration described above (such as with reference to FIGS. 1-7) also creates an illusion that is primarily viewable through the viewing port or portions of the container or object opposite the reflective surface. Hence, when a viewer chooses a viewing angle or line of sight not through the viewing port or frame about such a port, the viewer typically cannot see the primary image or at least the image does not appear to be projected within the container or object. This "disappearing" image furthers the illusion achieved by the present invention. For example, if the container 100 of FIG. 1 is viewed from the top or bottom. (e.g., upward or downward into the bottle), the image 129 is not visible within the container walls 112 while the image 129 is clearly visible through port 138 and appears to be within the container walls 112. Yet further, the invention provides a self-animating illusion in that as the container or object is moved or the viewer moves so as to change the line of sight or viewing angle through the viewing port the primary image being projected also appears to move or is animated. This illusion is achieved in some embodiments due to the combined use of a curved reflective surface and cylindrical lens (e.g., container walls and contents). In these embodiments, the change in viewing angle results in the primary image moving relative to the foreground images and the reflected background images. This self-animation effect improves the illusion by better detaching the primary image from the surface of the mirror and from the foreground images and reflected background images. In many cases, the sidewalls of the container or body of the object on or in which the visual display assembly is provided will be substantially transparent or translucent light to allow a viewer to see through the sidewalls and the interior of the container (which may be filled with liquid or solid that adds to the optical effect by providing more lens material or that is colored or opaque). However, it may be desirable to only provide a portion of such sidewalls that are transparent or translucent. For example, the sidewall may be translucent where the mirror element or only its reflective surface is positioned and where the framing element or only its viewing port or window is positioned or provided, and some or all of the rest of the sidewall or object body may be less transparent to opaque.

The above description describes in detail the use of the inventive concepts of a visual display assembly that includes a reflective surface (e.g., a curved or nonplanar mirror) with a proximate primary image, foreground and/or background images and a lens or optical system to achieve desirable optical imagery in containers. However, these inventive concepts can readily be expanded to non-standard "containers" and many other objects and products. For example, the containers in FIGS. 1-7 are shown to have smooth or relatively smooth sidewalls. In some embodiments, the sidewall opposite the reflective surface (e.g., front sidewall 114 in FIG. 1 or the like) is textured to create the viewing port and to create the foreground and background images. For example, one or more smooth areas may be provided on the front sidewall to provide one or more viewing ports or windows and shapes may be provided as raised or recessed surfaces in the sidewall. These textured shapes or surfaces are then seen in the foreground as images and also reflected from the reflective surface (e.g., mountains, stars, clouds, or nearly any other shape/design such as a cave or other design). These textured surfaces or shapes about the viewing port/window(s) may be provided in the sidewall during fabrication of the container (such by providing a particular mold for use in blow molding or the like) or later attached in a separate operation (e.g., a plastic label with a three dimensional surface may be attached to a container sidewall). Again, the images described herein may be provided by deposition techniques and by techniques that add or remove materials from surfaces (such as the interior or exterior surfaces of label substrates or sidewalls of containers or surfaces of objects).

In another example, visual display assembly may be provided as a more rigid package assembly rather than as with a thin flexible label or labels. This may involve providing a single piece or package assembly that is formed of plastic, ceramic, glass, or other material (or includes such transparent or translucent materials at least in the viewing port portion). The package assembly may have a cylindrical, oval, clam shell, or other cross section. The sidewalls are typically relatively rigid, such as 15 to 20 thousandths or more of plastic, ceramic, glass, or other material. This package assembly includes the framing element with the view port, foreground images, and background images and also the reflective surface and primary image (which may also be provided on or in the package contents). The sidewalls of this package assembly may provide the lens for the assembly and contents may be placed within the package assembly. In other cases, a lens element is inserted inside the container sidewalls with the sidewalls acting as a sleeve that fits over the lens element or as a shell (e.g., two halves of a clam shell or the like) that are closed on or wrapped about a lens element. The lens element may be a bottle or container as described in FIGS. 1-7 or take on other forms, such as a solid object such as a rod or cylinder formed of plastic, ceramic, glass, or the like. The sidewalls of the package assembly may configured to mate tightly or closely with the sidewalls or, in some cases, a space is left between one or both of the front and back sidewalls so as to achieve a differing visual effect (e.g., to achieve a 3D effect).

In yet another embodiment, the container of FIGS. 1-7 is replaced with a solid object (e.g., a block, a rod, or the like). For example, a label or labels providing the visual display assembly with its framing element and mirror element may be applied to a cylinder formed of a clear or translucent material such as a glass, ceramic or plastic (e.g., acrylic or the like) rod. The use of the a cylindrical object in place of the containers of FIG. 1-7 achieves similar or, in some cases, improved visual effects/results because the optical characteristics of the solid object are more readily understood and selected to achieve a desired effect when compared with a liquid provided in a container.

Figure 8:
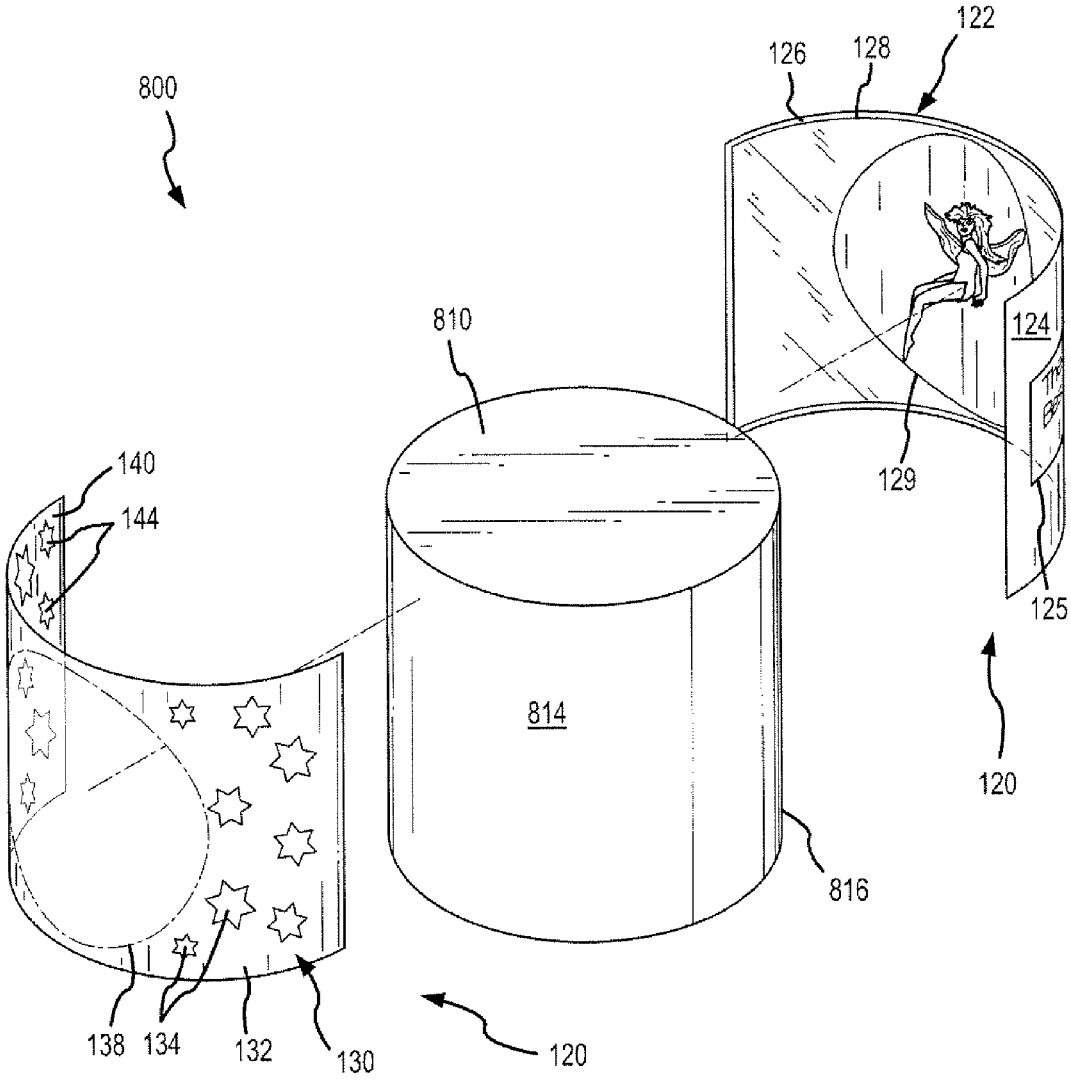
FIG. 8 is an exploded view similar to FIG. 1 of an optical illusion device or object according to another embodiment in which the container of FIG. 1 is replaced with a solid body.

FIG. 8 illustrates an optical illusion device or object 800 that includes a solid or substantially solid body 810 with a front portion or sidewall 814 and a rear portion or sidewall 816. The device 800 includes the visual display assembly 120 shown in FIG. 1 and, hence, the description of like numbered components with reference to FIG. 1 is applicable to FIG. 8 and device 800. The visual display assembly 120 includes a frame element 130 that is attached or provided on the front sidewall 814 of the body 810. A mirror element 122 with a reflective surface 128 is provided on the rear sidewall 816, and a primary image 129 is provided on the surface 128, on or part of the rear sidewall 816 or otherwise as described herein. In some embodiments, the image is provided within the body 800, such as in a curved or non-planar configuration proximate to the exterior surface of the body 800 near the mirror element 122 and reflective surface 128. The body 810 is shown to have a cylindrical configuration with a circular cross section (when viewed along its longitudinal axis). As with the container 100 of FIG. 1, the mirror element 122 is flexible or conformable and when applied or attached to the sidewall 816 the reflective surface 128 generally conforms to the shape of the body 810 and sidewall 816. In addition to the curved surface 128, an optical illusion is achieved by the use of body 810 as an optical element or lens, which in this case is cylindrical. The body 810 (at least at the portion between the frame and mirror elements 122, 130) is clear or substantially transparent/translucent and may be formed of plastic (such as an acrylic or the like), glass, ceramic, or the like or some combination thereof that provide desirable optical characteristics.

Figure 9:
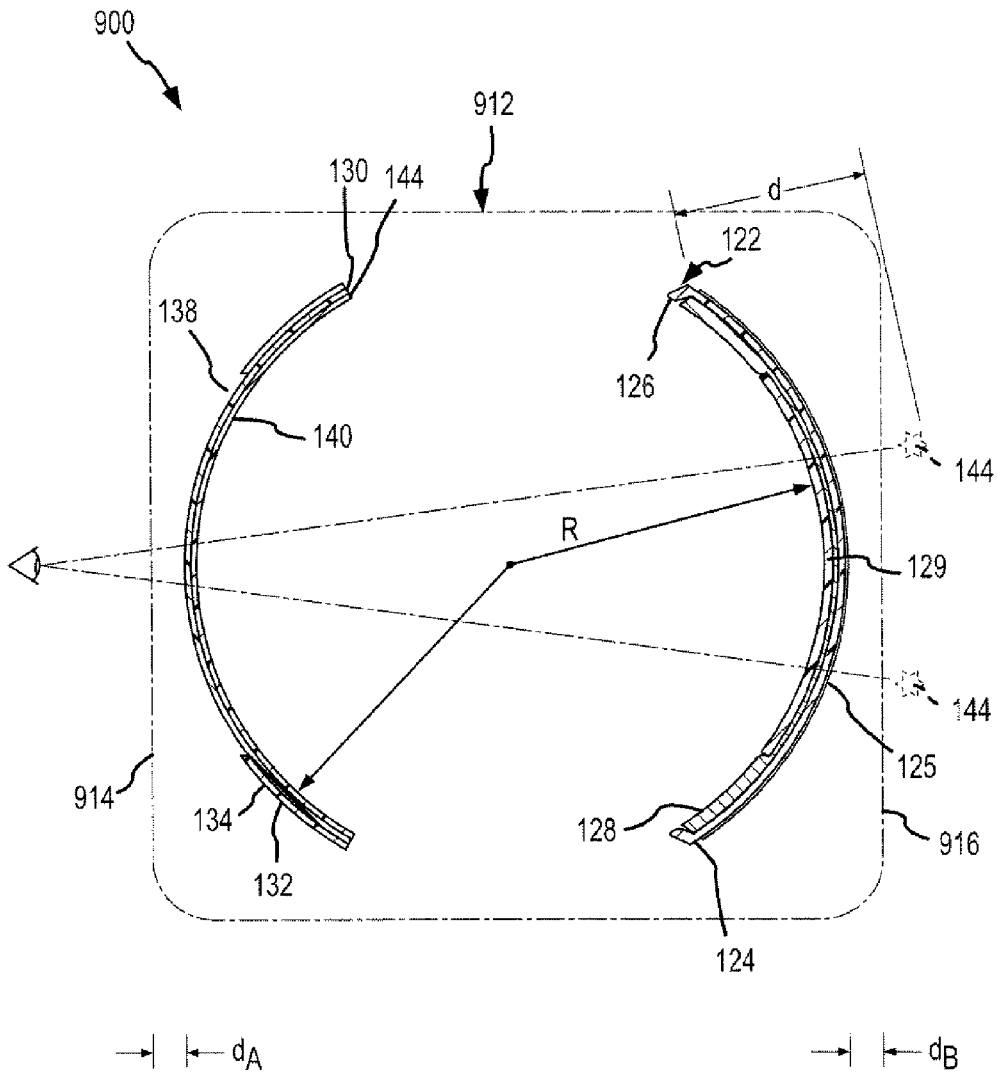
FIG. 9 is a sectional view similar to FIG. 3 of another embodiment of an optical illusion device or object of the invention in which the visual display assembly is embedded within a solid body rather than being positioned on its surface in the embodiment of FIG. 8 (with the body shown with phantom lines and without sectional lines for clarity in illustration but to be understood as representing a solid body or "cube")

In some cases, it may desirable to encase all or a portion of the visual display assembly within the optical illusion device or object. For example, the visual display assembly in a container may be provided within the sidewalls (such as with a hollow sidewall) or be provided on the interior surfaces of the sidewall rather than on the exterior as is shown in FIGS. 1-7. If a solid body is used, the mirror element and/or the frame element may be embedded or otherwise positioned or provided within the body itself FIG. 9 illustrates a cross section (similar to that of FIG. 3) of an optical illusion device or object 900 that includes a body 912, such as a unitary piece of plastic, glass, ceramic or the like. As shown, the body 912 includes a front portion or sidewall 914 and a rear portion or sidewall 916.

The body 912 is shown to have a square cross section, but other cross sectional shapes such as circular, rectangular, triangular, or other shape may be used in the embodiment 900. These other cross sectional shapes may be utilized in the embodiment 900 in part because the visual display assembly 120 is positioned within the body 912 and is arranged to have a nonplanar or arcuate cross section as was the case of the assembly 120 at least in FIGS. 1, 3, and 8, with each element 122, 130 having a radius R (e.g., the same radius is typically used but the two elements may have differing radii in some cases). A relatively thick substrate may be used for the mirror element 122 and frame element 130 to provide a desired level of rigidity, the elements 122, 130 may be positioned in a base (not shown) in an arcuate configuration, and the body 912 may be formed, poured, or molded about the elements 122, 130. In this manner, the embedded visual display assembly 120 provides a curved reflective surface 128 that faces the back side 140 of frame element 130 so as to reflect background images 144. A primary image 129 is provided on or proximate the reflective surface 128 and is shown to be flat or thin and to have the same shape as the reflective surface 128. The two elements 122, 130 may be offset from the exterior surface of the rear and front sidewalls 916, 914, respectively, such as distances $d_A$ and $d_B$, which may be equal or differ to practice the invention and range from a few mils up to half an inch or more.

The device 900 is useful for illustrating that the visual display assembly 120 can be used in a wide variety of products to achieve an optical illusion as long as the mirror element 122 and its reflective surface 128 and primary image 129 can be seen through a container, product or object body, or the like. Typically, a framing element 130 is also provided but can be provided on an external surface, on an interior surface, as part of the products exterior walls, or embedded in such a wall or body of the device.

Because the number and variety of products that may incorporate the present invention are numerous it may be useful to list a representative group of products that are considered to be covered within the breadth of the above description and language of various ones of the following claims. A "container" is intended to be relatively broad term and include nearly any object with walls having exterior surfaces and may include objects that arc solid with the container walls defining the shape and size of the object. The visual display assembly is then typically applied or provided on the exterior surfaces of such an object. In other cases, the visual display assembly may be provided as part of one of these walls or even be provided on interior surfaces. Products that may utilize the container and visual display assemblies of the invention include, but are not limited to, bubble bath, shampoo, and other consumer product bottles or containers, baby bottles, aquariums, sport bottles, pens, perfume containers, windshield fluids, translucent oil containers, toys with cylindrical or non-planar surfaces such as teething devices, rattles, and the like, beach balls, floatation devices, and other inflatable toys and objects, syringes, intravenous pouch, glue tubes/packages, globes (e.g., snow globes that may include 3D objects In the container and floating objects such as glitter in the contained liquid), home/business water bottles and purifiers, consumer water bottles, cups, and carbonated beverage containers.

When it is understood that the inventive concepts described herein are applicable to non-standard containers and objects that may be solid, the listing of products and apparatus that may incorporate a visual display assembly of the invention can be expanded even further. The following is a non-exclusive listing of other products that may incorporate a visual display assembly: ornaments, devices with LED or other sources of light for lighting the interior of the "container," an alarm clock, floating/animated time face devices, floating plasma-type TVs and electronics, lamps, comic books, jewelry, key chains, and the like.

Further, these non-standard container embodiments and the container embodiments (such as those shown in FIGS. 1-7) may be adapted to achieve additional effects or to have additional features. For example, light sources such as LEDs or the like may be provided on or within the container or assembly to light the container contents or to light one or more of the images so as to achieve a desired effect (e.g., to selectively illuminate portions of the image with the light source). Other supplementary lighting such as conventional table lamps, flashlights, or lighted display stands/cases may be used to increase the quantity or quality of available light. The use of supplementary lighting increases the quantity of light available to produce the illusion and may improve the quality of the illusion, compensate for lower reflectivity films, and/or allow for darker images or designs whose performance would be limited by relying on ambient lighting alone. Supplementary lighting may be modulated to provide colors and/or polarization or other qualities that are not readily controlled with ambient light alone and, therefore, enable a wider variety of visual effects.

Figure 10:
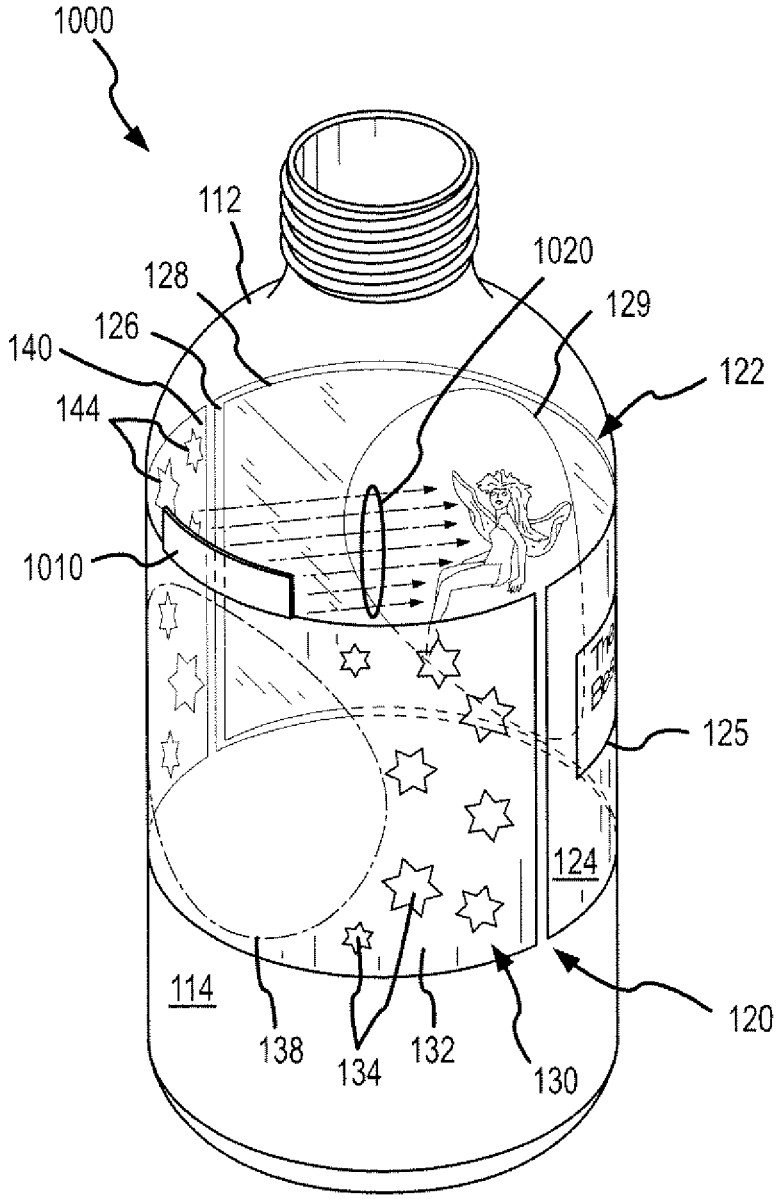
FIG. 10 is a perspective view similar to FIG. 2 of another embodiment of an optical illusion device or object in which a light source is provided to illuminate internal portions of the device and/or the primary image and reflective surface.

FIG. 10 illustrates an optical illusion device or container 1000 with a sidewall 112 that defines an interior void or space for receiving a product (that may be replaced by a body, such as unitary body such as shown in FIGS. 8 and 9, i.e., the use of a supplemental light source 1010 is not limited to container embodiments but is useful for all the other embodiments described herein). The device 1000 includes similar components as found in the container 100 of FIG. 1 and the prior description applies also to device 1000 and is not repeated here. Specifically, the device 1000 includes a visual display assembly 120 with a frame element 130 and a mirror element 122 that are applied to exterior surfaces of the sidewall 112. As discussed, a desirable visual effect may be achieved by providing a light source to supplement ambient lighting. To this end, the device 1000 includes a light source 1010 that functions to generate light 1020 that is generally directed inward from sidewall 112, and more specifically, inward from the front portion 114 into the void or interior space so as to "light" the contents of the device 1000 (or interior portion of a body in embodiments such as 800). The light source 1010 may be positioned so as to direct its generated light 1020 toward or onto the primary image 129 to provide an enhanced illusion. In other embodiments, the source 1010 may be directed toward the background images 144 on the frame element 130 or additional sources 1010 may be provided to achieve this supplemental lighting.

The light source 1010 is shown to be an additional component that may be attached to the frame 130 prior to attachment of the frame element to sidewall 112. In other cases, the source 1010 is provided as an integral part of the frame element 130 (or mirror element 122), e.g., a part of a wrap around label or multi-piece label or the like. In these cases, the source 1010 may extend out from the element 130 (or 122) as shown or be more integrated into the frame 130 (or 122), e.g., provide part of the foreground 132 that is opaque or substantially opaque. The light source 1010 may take many forms to practice the invention and generally includes a power source (such as a battery, a solar power source, or the like) and a light generator such as an light emitting diode (a thin film LED, an organic LED, or the like), a flat light, a light bulb, or any other useful light generation device. In some embodiments, it is desirable that the source 1010 be thin, lightweight, and inexpensive and, in these embodiments, LEDs or similar sources may be utilized to generate white or colored light. In some embodiments, a switch (not shown) is provided to allow the light source 1010 to be turned on and off to selectively generate light 1020, which may be used to create two differing effects (e.g., portions remain hidden until the light source 1010 is activated). The switch may be manual to allow a user to control the effect created by the device 1000 and/or be automated to occur periodically or upon the occurrence of a triggering event (such as when the device 1000 is moved or tipped or an amount of time lapses). The size and shape of the light source 1010 and the produced light 1020 (and its power) may also be varied to practice the invention and to achieve a particular effect.

Figure 11:
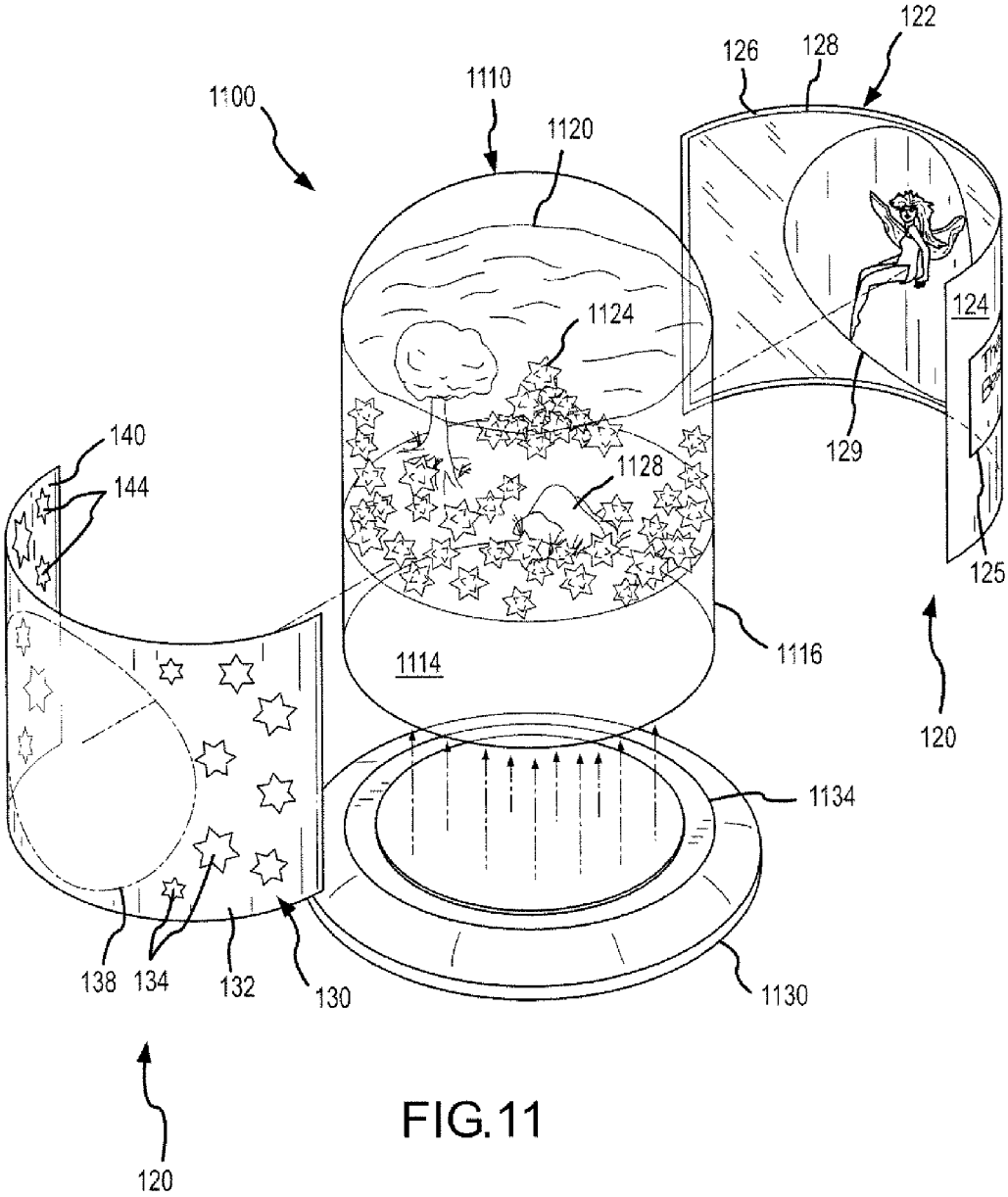
FIG. 11 is a perspective view similar to FIG. 10 of another embodiment of an optical illusion device or object in which a light source is provided as an attached or detachable/separate base for the body or container.

FIG. 11 illustrates another optical illusion device 1100 of the invention that makes use of a supplemental light source 1134 to provide an enhanced visual display. As shown, the device 1100 utilizes the visual display assembly 120 shown in FIG. 1 with its mirror element 122 and frame element 130. In the device 1100, the "container" or body 1110 is a hollow globe (or portion of a sphere such as used to produce "snow globes") with a front sidewall 1114 and a rear sidewall 1116 that define an interior void or space in which a liquid 1120 is provided. The frame element 130 is attached to the front portion 1114 and the mirror element 122 is attached to the rear portion 1116 so as to be on opposite or opposing sides of the container or body 1110 such that the view port 138 is opposite the primary image 129 and reflective surface 128. The liquid 1120 typically does not fill the interior of the body 1110 to allow it to be shaken or moved by a user of the device 1100. In the interior space of the body or container 1110, three dimensional objects may be provided and left unattached as shown with objects 1124 to move within the liquid 1110 or affixed as shown with object 1128, and these additional objects 1124, 1128 are generally selected to enhance the visual display and mate or correlate with the primary image 129, the background images 144, and foreground images 134. Again, the body 1110 may be solid or a unitary construction (such as a molded plastic, ceramic, or glass) in some embodiments with the sidewalls 1114, 1116, and 1120 being replaced by a single component or body (or a body formed of two or more pieces).

To provide supplemental light in this device 1100, a light source (not shown) may be attached separately or as part of the visual display assembly 120 as shown in FIG. 10. Or, as shown, the device 1100 may include a base 1130 with a light source 1134 that directs light upward into the body 1110 and liquid 1120. The light source 1134 again typically includes a power source and light generator such as one or more LEDs, bulbs, or the like. The base 1130 may be attached to the body 1110 or be provided as a separate unit. For example, the base 1130 may take on an appearance similar to a coaster used to protect surfaces from glasses. In this case, the source 1134 may have a switch that activates the source 1134 and generates light when the body is set upon the base 1130. Additionally or in place of such a switch, the source 1134 may be activated manually or automatically as discussed with reference to the device 1000 of FIG. 10. Again, the light generated by the source 1134 may be colored, may be directed generally upward or be directed to specific portions of the display (i.e., the images 129, 144 or object 1128 or elsewhere).

The visual display element or portions of such a display element may be replaceable to allow one or more of the images to be changed. Alternatively, the visual display assembly or portions of it may be moveable (e.g., the assembly may be provided on a label or sleeve that can be rotated about the periphery of the container), which may be used to change the images being displayed (e.g., change the foreground and background images and/or change the primary image). The visual display assembly may include multiple viewing ports and/or reflective surfaces so as to provide multiple panels for showing differing images and/or for telling a story. In some embodiments, the container sidewall, the label material, the image ink, and/or the container contents may be temperature sensitive so as to change with varying temperatures (e.g., show a different character, changed character, different/changed background and/or foreground images, and the like in different temperature ranges). The images used in the visual display assembly may be printed with ink to allow them to be seen in the dark (i.e., glow in the dark effects) or under a black light.

The images used in particular implementations may be aesthetic, entertaining, and/or informational. For example, the images may contain a barcode that implements a game piece, coupon, or UPC code that is secure because it is formed facing toward the inside of a container. A security image (e.g., a barcode) may comprise portions of the primary image, foreground image, and/or background image all of which must be present in a composite image. This not only inhibits tampering with the security image itself but also can provide some confirmation of product/container integrity as the composite image can be made to be very sensitive to container damage or changes in the contents. The images can be used to display product information such as ingredients, nutritional information, directions for use, and the like. The images can be contextually tied to the product (e.g., floating lemons in a lemon flavored beverage) or contextually unrelated to the product (e.g., cartoon characters or film promotional images inside a cup).

I claim:

1. An apparatus for providing a visual display, comprising:

a body having a front sidewall and an opposing back sidewall;

a mirror element provided proximate to the back sidewall and comprising a non-planar reflective surface; and a primary image element positioned proximate to the reflective surface and between the reflective surface and the front sidewall.

2. The apparatus of claim 1, wherein the primary image element and reflective surface are visible through at least a portion of the front sidewall.

3. The apparatus of claim 1, further comprising a framing element proximate the front sidewall, the framing element comprising one or more background image elements facing toward the back sidewall and the reflective surface.

4. The apparatus of claim 3, wherein the framing element further includes a substantially transparent viewing window free of the background images and through which a line of sight is provided through the body to the reflective surface of the mirror element.

5. The apparatus of claim 4, wherein the framing element further comprises a foreground image element defining outer boundaries of the viewing window and facing away from the back sidewall, whereby the background images are viewable through the viewing window via the reflective surface.

6. The apparatus of claim 1, wherein the body comprises a substantially continuous piece of plastic, ceramic, or glass between the front sidewall and the opposing back sidewall.

7. The apparatus of claim 1, further comprising a light source generating light for illuminating at least the primary image.

8. An optical illusion device, comprising:

a body comprising a front sidewall formed of an at least partially transparent material and a rear sidewall opposite the front sidewall and formed of an at least partially transparent material;

a primary image element proximate to a surface of the rear sidewall;

a mirror element with a reflective surface proximate to the rear sidewall such that the primary image is proximate to the reflective surface; and a framing element on the front sidewall, the framing element comprising a substrate with an inner and outer surface and set of background image elements provided on the inner surface, wherein the inner surface contacts the exterior surface of the front sidewall.

9. The device of claim 8, wherein the framing element further comprises a viewing port extending through the substrate and defining a window through which a line of sight is provided to the primary image element and the adjacent reflective surface.

10. The device of claim 8, further comprising a light source transmitting light into the body.

11. The device of claim 10, wherein the framing element, the mirror element, and the light source are provided in a label that is attached to the body.

12. The device of claim 10, wherein the light source comprises a light emitting diode.

13. The device of claim 8, wherein the rear sidewall has a semi-circular cross section defined by a radius and the reflective surface and the primary image element are mounted on the rear sidewall to conform to the rear sidewall and the radius.

14. An apparatus adapted for producing multidimensional visual effects, comprising:

a mirror element comprising a reflective surface having a curved shape and a printed primary image proximate to the reflective surface and at least partially conforming to the curved shape of the reflective surface; and a framing element spaced apart from the mirror element, the framing element comprising a background image element and a view port, the view port being positioned opposite the primary image to provide a line of sight through the framing element to the reflective surface and the primary image.

15. The apparatus of claim 14, wherein the background image element is positioned to provide a line of sight through the view port so that the background image element is viewable in the reflective surface.

16. The apparatus of claim 14, wherein the background image element is positioned to provide a line of sight through the view port so that the background image element is viewable in the reflective surface concurrently with viewing the primary image through the view port.

17. The apparatus of claim 14, further comprising a lens formed of at least one substantially transparent material and sandwiched between the reflective surface and the framing element.

18. The apparatus of claim 17, further comprising means for generating light and directing the generated light into the lens.

19. The apparatus of claim 17, further comprising a packaging assembly including the mirror element and the framing element and adapted for application about exterior surfaces of the lens.

20. The apparatus of claim 14, wherein the background image element comprises a surface with a plurality of raised or recessed portions configured to generate a reflected image viewable through the viewing port via the reflective surface.

21. An item for creating an optical illusion or display, comprising:

a reflective element;

a primary image proximate to the reflective element and positioned such that the primary image and the reflective element can be viewed together over a range of viewing angles; and a framing element permitting views at the range of viewing angles.

22. The item of claim 21, wherein the primary image is attached to the reflective element.

23. The item of claim 21, further comprising an opening formed in the reflective element, wherein the primary image is behind the reflective element and can be viewed through the framing element and the opening formed in the reflective element.

24. The item of claim 21, wherein the primary image is in front of the reflective element.

25. An assembly comprising the item of claim 24.

26. The item of claim 25, wherein the assembly comprises one or more of components selected from the group consisting of a label, a container, a bottle, a pen, a toy, and a novelty product.

27. The item of claim 21, wherein the reflective element comprises a metal layer.

28. The item of claim 21, wherein the reflective element comprises paint.

29. The item of claim 21, wherein the framing element contains at least one background image.

30. The item of claim 29, wherein the at least one background image can be seen in the reflective element over the range of viewing angles.

31. A method for producing a multidimensional composite image, comprising:

providing a primary image proximate to a reflective surface and a background image spaced apart from the reflective surface, wherein the primary image is positioned between the reflective surface and the background image;

illuminating the primary image and the background image; and forming a composite image comprising light from the illuminated primary image and light from the reflective surface including light from the illuminated background image, wherein the primary image appears in the composite image to be located in front of the background image and spaced apart from the reflective surface.

32. The method of claim 31, wherein the forming of the composite image comprises directing the composite image to a viewing port positioned proximate to the background image.

33. The method of claim 31, wherein the reflective surface has a semi-circular cross section.

34. The method of claim 31, further comprising providing a foreground image proximate to the background image and illuminating the foreground image and wherein the composite image further comprises light from the illuminated foreground image, whereby the primary image appears in the composite image to be located in front of the background image and behind the foreground image.

35. The method of claim 31, wherein the providing comprises forming an object that includes the primary image, the background image, and the reflective surface.

36. The method of claim 31, wherein the illuminating comprises using a light source to direct light onto the primary image and the background image.

* * * * *